US005910003A

United States Patent [19]

Kleinpaul

[11] Patent Number: 5,910,003

[45] Date of Patent: Jun. 8, 1999

[54] LOCKING DEVICE FOR GUNS

[75] Inventor: Cláudio Alexandre Kleinpaul, Porto Alegre, Brazil

[73] Assignee: Forjas Taurus S/A, Brazil

[21] Appl. No.: 08/939,542

[22] Filed: Sep. 29, 1997

[30] Foreign Application Priority Data

Oct. 25, 1996 [BR] Brazil ..... 9604462
Jul. 18, 1997 [BR] Brazil ..... 002489

[51] Int. Cl.[6] ..... F41A 17/00

[52] U.S. Cl. ..... 42/70.11; 42/70.08

[58] Field of Search ..... 42/70.11, 70.08

[56] References Cited

U.S. PATENT DOCUMENTS

| | | | |
|---|---|---|---|
| 333,416 | 12/1885 | Kelton | 42/66 |
| 565,678 | 8/1896 | Foster | 42/66 |
| 774,712 | 11/1904 | Vold | 42/70.11 |
| 1,227,531 | 5/1917 | Donadio | 42/70.08 |
| 3,553,877 | 1/1971 | Welch et al. | 42/70 |
| 4,768,302 | 9/1988 | Beretta | 42/70.08 |
| 4,769,936 | 9/1988 | Miller | 42/66 |
| 4,972,618 | 11/1990 | Justice, Sr. et al. | 42/70.11 |
| 5,042,185 | 8/1991 | Justice, Sr. | 42/70.11 |
| 5,208,406 | 5/1993 | Badali | 42/70.08 |

*Primary Examiner*—Charles T. Jordan
*Assistant Examiner*—Meena Chelliah
*Attorney, Agent, or Firm*—Bachman & LaPointe, P.C.

[57] ABSTRACT

A locking device for guns, comprising a cylindrical locking pin housed in a housing cavity made in a suitable part of the revolver, having one operable head portion apparent on the external surface of the revolver and an opposite end portion, and a substantially helicoidal groove cooperating with a retention pin, the device locking the revolver when, upon operation with a suitable key, the said locking pin translates inside its housing cavity projecting one of its ends outwards the said housing cavity in order to cooperate with the striking surface so that the said projected end obstructs hammer cocking movement.

5 Claims, 6 Drawing Sheets

LOCKING DEVICE FOR GUNS

The present invention refers to a locking device for guns, more precisely to a locking device able to prevent the use of a revolver, a pistol or the like, either by unauthorized people or unable people, for instance children.

The state of art comprises several kinds of locking devices for guns. One of them consists of a block made of hard plastic material designed to be interposed between the back of the trigger and the frame surrounding the trigger. When locked in place with a suitable key, this device avoids trigger movement, so that the revolver cannot be cocked and therefore cannot be shot, unless the user withdraws this block from its locking position using a suitable key. A locking device like this one works well but has the drawback of being external to the revolver, so that when not in use, it can be lost, the revolver becoming usable by either unauthorized or unable people like children.

Another kind of locking device for revolvers is that disclosed in the Brazilian Patent PI 8904218-2. This locking device comprises a cylindrical body housed in the handle of the revolver, perpendicular to the main spring guide and beneath the main helical spring bearing. The cylindrical body has a hole perpendicular to its axis and also an apparent end in the handle, this apparent end engages with a suitable key only.

When the revolver is unlocked, the cylindrical body hole is aligned with the lower end of the main spring guide, therefore allowing the downward movement of the main spring guide upon cocking the hammer; in this situation, the user can fire shots with the revolver. In order to lock the revolver, the user must rotate the cylindrical body about 90° with the aid of the suitable key, so that the end of the main spring guide cannot pass through the hole, avoiding the downward movement of the main spring guide and therefore avoiding the cocking of hammer.

This kind of locking device works well too, but can be employed only in revolvers that comprise a main spring of helical kind with a main spring guide, not to a revolver comprising a main spring of the blade kind.

It is the object of the present invention to provide a locking device for revolvers, pistols and the like that overcomes the drawbacks of state of art locking devices.

Particularly, it is the object of the present invention to provide a locking device for guns which can be employed in revolvers of both helical and blade main springs.

It is still another object of the present invention to provide a locking device which can be adapted into revolvers already produced and sold.

These objects are achieved by a locking device comprising a cylindrical locking pin housed in a housing cavity made in a suitable part of the revolver, having one operable head portion apparent from the external surface of the revolver and an opposite end portion, and a substantially helicoidal groove cooperating with a retention pin, the device locking the revolver when, upon operation with a suitable key, the said locking pin translates inside its housing cavity projecting one of its ends outwards the said housing cavity in order to co-operate with the striking surface so that the said projected end obstructs hammer cocking movement.

The device will be locked when one of the two opposite ends of the locking pin is projected out of its respective housing cavity and cooperates with a given striking surface, and otherwise the device will be unlocked when none of the two opposite ends of the locking pin is projected out of its respective housing cavity and cooperates with a given striking surface.

Preferentially, the said operable head portion apparent from the external surface of the revolver has connective means to engage with a suitable key only, and cooperates with the said locking pin, there are positioning means designed to establish the two correct positions that the device can be in assume, either "locked" or "unlocked".

In one preferred embodiment of the present invention, this locking pin is housed in a cavity made in the rear portion of the hammer. In this preferred embodiment, the revolver is locked when after rotation of the locking pin with the aid of the suitable key, the head portion of the locking pin remains in a projected position relative to the rear surface of the hammer, in order to cooperate with a striking edge of revolver frame. In this embodiment, the locking position of the device is achieved when one end of the locking pin (head portion) cooperates with a given striking surface (striking edge of revolver frame).

In an alternative embodiment of the present invention, this locking pin is housed in a cavity made in the rear upper portion of revolver frame. In this alternative embodiment, the revolver is locked when the locking pin end opposite to the head portion remains in a projected position relative to the inner surface of the revolver frame, in order to cooperate with a hammer striking edge provided in the rear portion of the hammer. In this alternative embodiment, the locking position of the device is achieved when one end of the locking pin (the end opposite to the head portion) cooperates with a given striking surface (hammer rear striking edge).

The locking device of the present invention will be better understood with the following description of a revolver, but not limited to, made with reference to the drawings attached hereto, in which.

Figure 1:
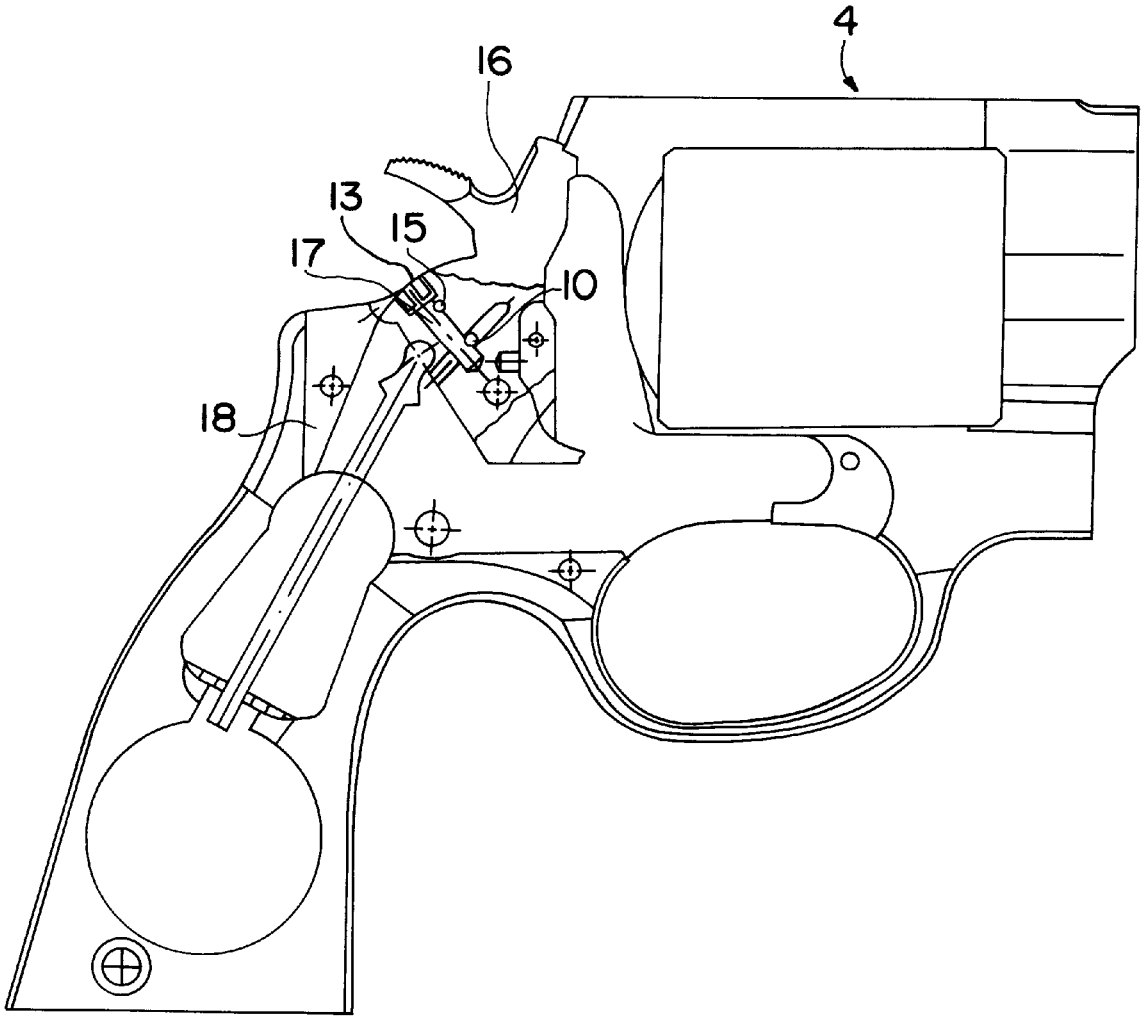
FIG. 1 is a side view of a revolver frame, showing a partially sectioned hammer incorporating a locking device in the "unlocked" position according to a preferred embodiment of the present invention.

According to the drawings, the locking device of the present invention comprises a cylindrical locking pin (1) with a substantially helicoidal groove (2) and an operable head portion (3) apparent on the external surface of the revolver (4) having means to engage with a suitable key (5) only, which means comprise a hexagonal cavity (6) with a central rod (7). Cooperating with this locking pin (1), more particularly cooperating with the locking pin positioning cavity (8), there are positioning means (10) designed to establish the two correct positions that the device can assume, either "locked" or "unlocked". In order to anchor the locking pin (1) in its suitable housing cavity (13, 14), a retention pin (15) which cooperates with the said locking pin helicoidal groove (2) is provided.

The locking pin head portion (3) has an upper round end to avoid its operation by means of pliers or other tool different from the suitable key (5). The said suitable key (5) has an operable hexagonal end (11) comprising a central cavity (12) matching the shape of the central rod (7) of the locking pin head portion cavity (6).

The said positioning means (10) that cooperate with the said locking pin cavity (8) can comprise a ball-spring or plunger-spring set housed in a suitable cavity.

Figure 2:
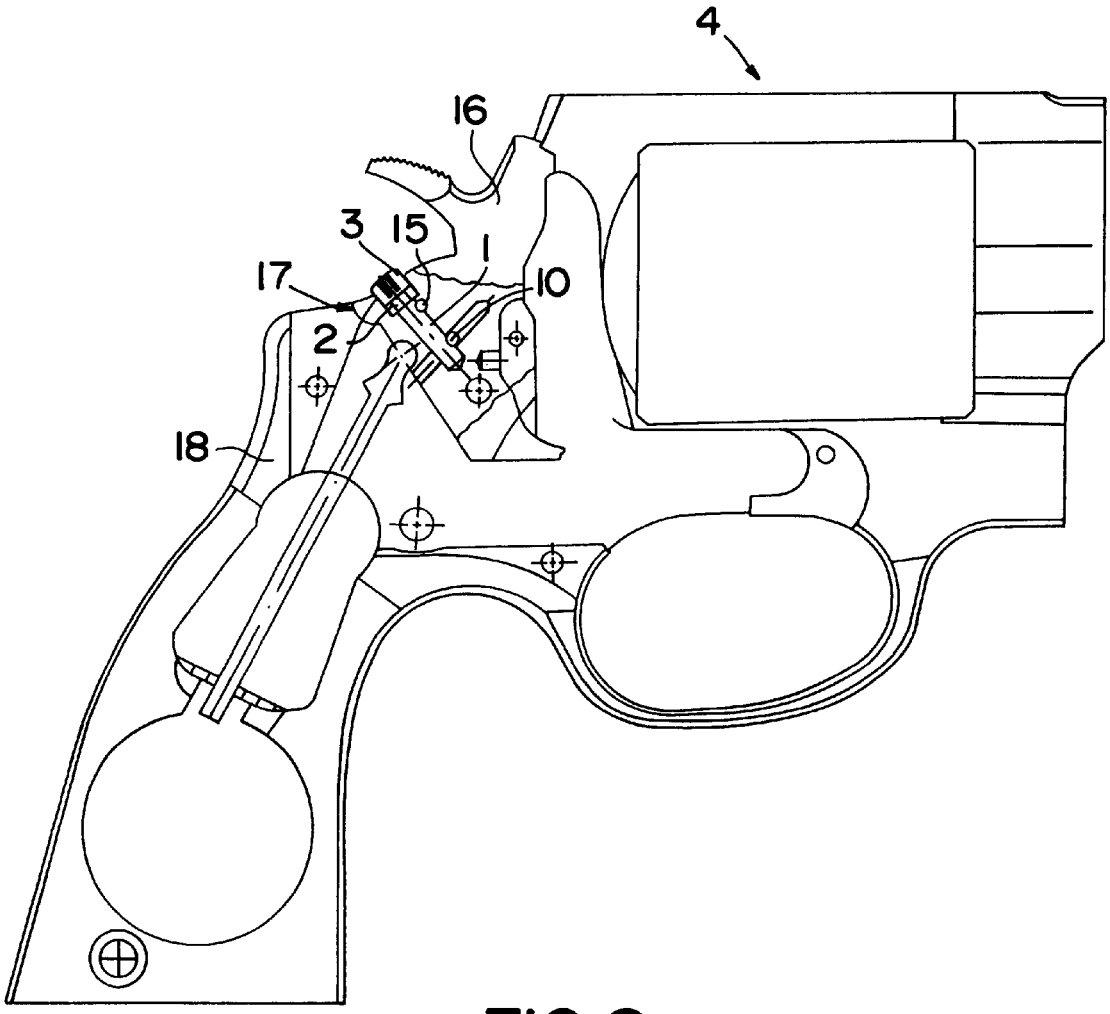
FIG. 2 is a side view of a revolver frame, showing a partially sectioned hammer incorporating a locking device in the "locked" position according to a preferred embodiment of the present invention.

With reference to FIGS. 1 and 2, in the preferred embodiment of the locking device for revolvers according to the present invention, the said locking pin (1) is housed in a cavity (13) made in the hammer (16). In this preferred embodiment, the hammer (16) also incorporates both positioning means (10) and retention pin (15). In FIG. 1, the locking device is shown in its "unlocked" position; in this position the user can fire shots with the revolver, since the locking pin head portion (3) is entirely inside its housing cavity (13) and therefore nothing obstructs hammer cocking movement.

In order to achieve the "locked" position shown in FIG. 2, the user must first engage the operation end (11) of the suitable key (5) with the locking pin head portion cavity (6), and rotate the locking pin (1) about 90°, until positioning means (10) engage in the cavity (8) relative to the "locked" position. In doing so, the retention pin (15) cooperating with the locking pin helicoidal groove (2) forces the locking pin (1) to translate inside its housing cavity (13), which projects the locking pin head portion (3) out of the rear surface of the hammer (16). Once the device is in the "locked" position shown in FIG. 2, the user cannot fire shots with the revolver, since the locking pin head portion (3) obstructs hammer cocking movement now by cooperating with a striking edge (17) of the revolver frame (18).

Figure 3:
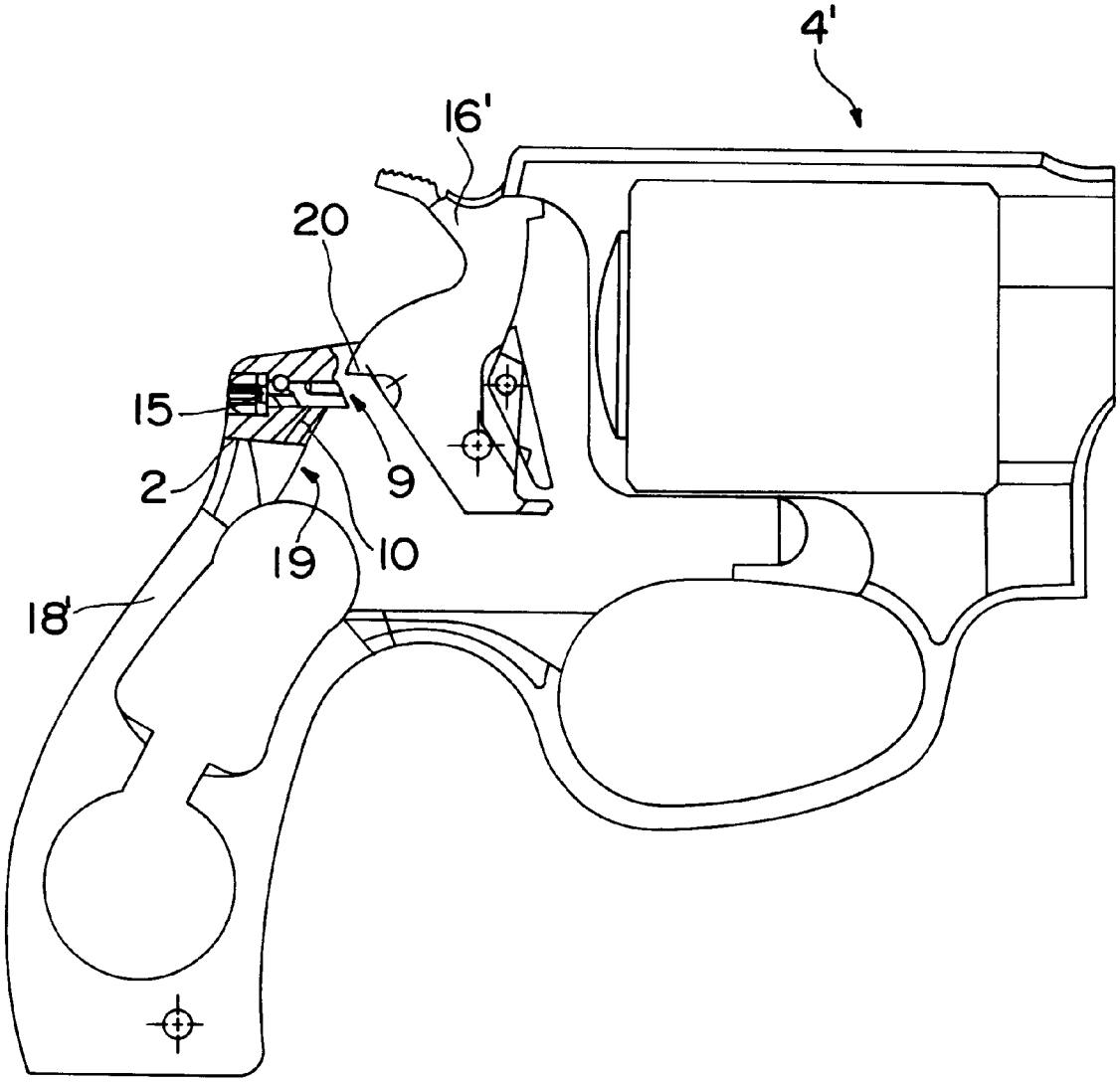
FIG. 3 is a side view of a revolver frame partially sectioned in its upper rear portion, where the frame incorporates a locking device according to the alternative embodiment of the present invention, the locking device shown in the "unlocked" position.
Figure 4:
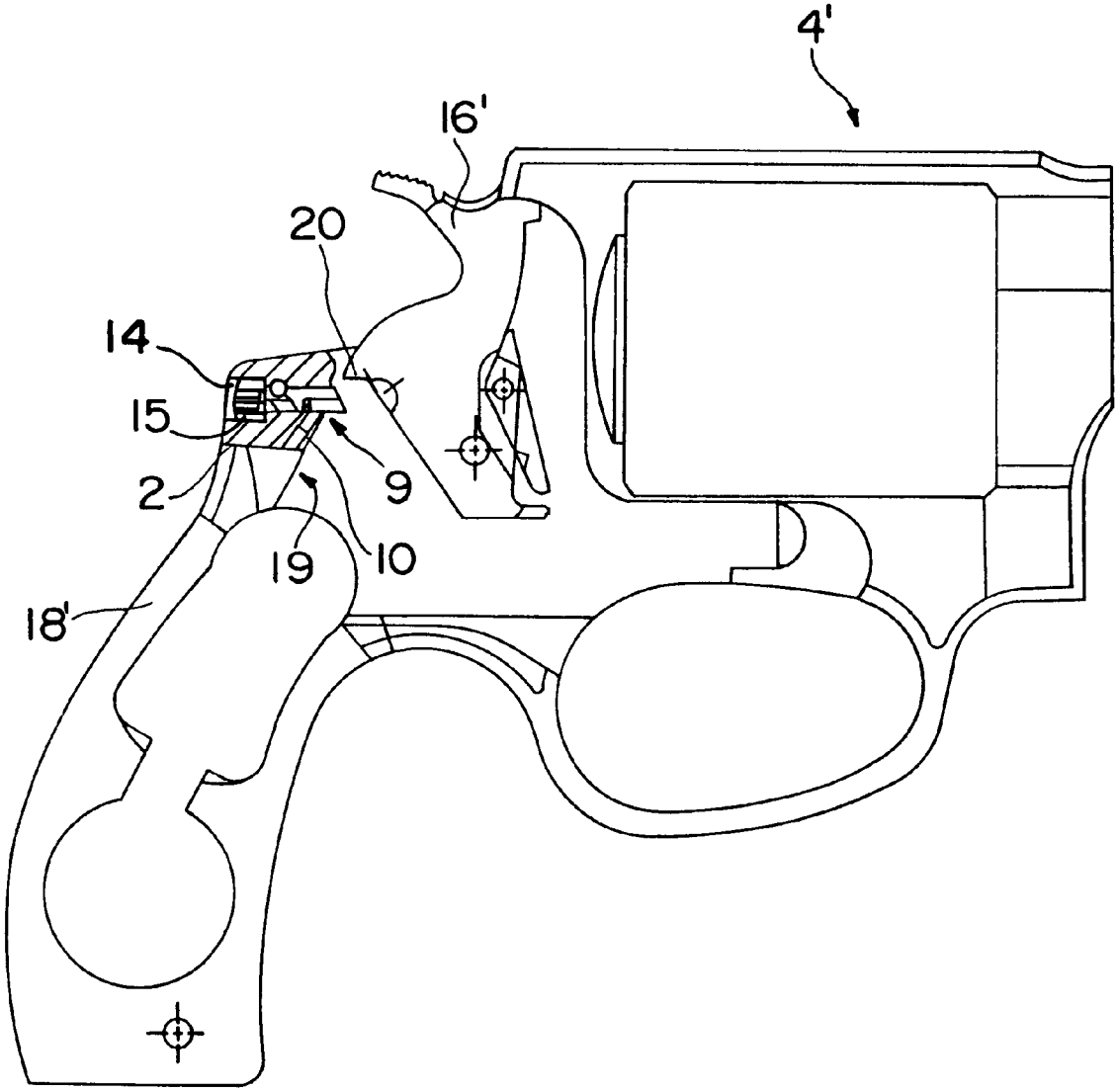
FIG. 4 is a side view of a revolver frame partially sectioned in its upper rear portion, where the frame incorporates a locking device according to the alternative embodiment of the present invention, the locking device shown in the "locked" position.
Figure 5:
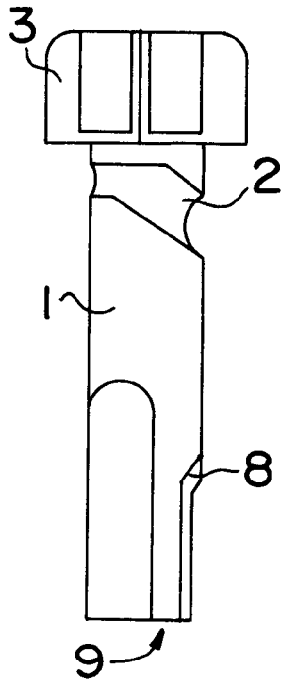
FIG. 5 is a front view of the locking pin of the locking device according to the present invention.
Figure 6:
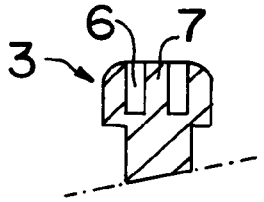
FIG. 6 is a cross-sectional view of the head portion of the locking pin shown in FIG. 5.
Figure 7:
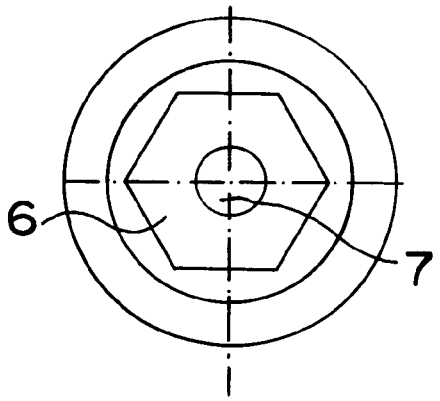
FIG. 7 is a plan view of the locking pin shown in FIG. 5.
Figure 8:
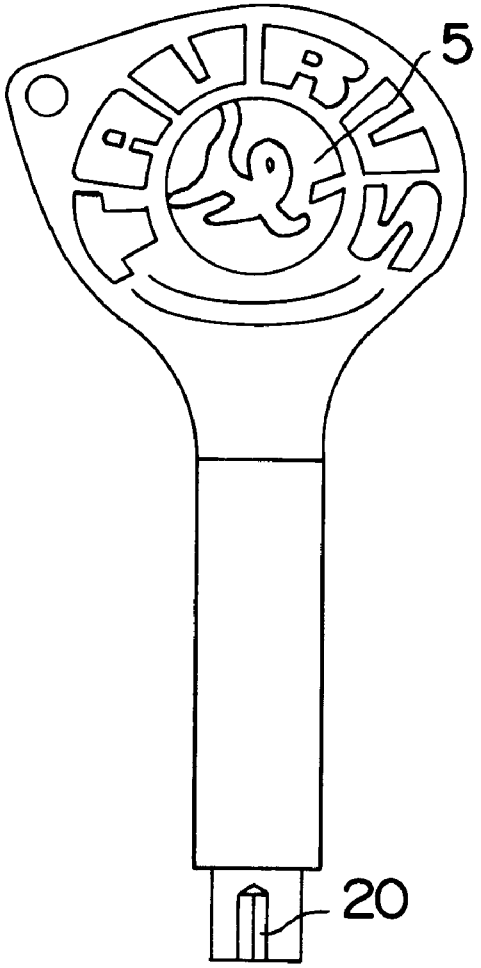
FIG. 8 is a front view of a suitable key to operate the locking device of the present invention.
Figure 9:
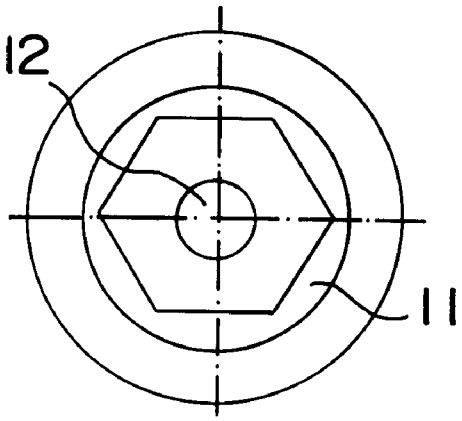
FIG. 9 is a view from below of the lower end of the key shown in FIG. 8.

With reference to FIGS. 3 and 4, in the alternative embodiment of the locking device for revolvers according to the present invention, said locking pin (1) is housed in a cavity (14) made in the upper rear portion of the revolver frame (18'). In this alternative embodiment, the said portion of the revolver frame (18') also incorporates both positioning means (10) and retention pin (15). In FIG. 3, the locking device is shown in its "unlocked" position; in this position the user can fire shots with the revolver, since the locking pin end (9) is entirely retracted in its respective cavity (14) and therefore nothing obstructs hammer cocking movement.

In order to achieve the "locked" position shown in FIG. 4, the user must first engage the operation end (11) of suitable key (5) with locking pin head portion cavity (3), and rotate the locking pin (1) about 90°, until positioning means (10) engage in the cavity (8) relative to the "locked" position. In doing so, the retention pin (15) cooperating with the locking pin helicoidal groove (2) forces the locking pin to translate inside its housing cavity (14), which projects the locking pin end (9) opposite to the head portion (3) from the inner surface (19) of the revolver frame (18'). Once the device is in the "locked" position shown in FIG. 4, the user cannot fire shots with the revolver, since the said locking pin end (9) obstructs hammer cocking movement now by cooperating with a striking edge (20) of hammer (16').

It must be clear that in both preferred and alternative embodiments of the present invention shown in FIGS. 1 to 4, to pass from "locked" position to "unlocked" position, the user must only proceed in the contrary way to that described in order to achieve the "locked" position.

I claim:

1. Locking device for guns, comprising: a revolver having a rear portion with an external surface thereof and a hammer therein operative to move to the hammer cocking position and a revolver frame having a striking edge for said hammer; a locking pin housed in a housing cavity made in said rear portion of the revolver; an operable head portion of said locking pin apparent on the external surface and an opposite end portion of said locking pin and a substantially helicoidal groove of said locking pin cooperating with a retention pin; wherein the device locking the revolver when, upon operation with a suitable key, the said locking pin translates inside said housing cavity projecting said head portion outwards of the said housing cavity in order to cooperate with said striking edge so that said projecting head portion obstructs hammer cocking movement.

2. Locking device according to claim 1, wherein said operable head portion apparent on the external surface of the revolver has connective means to engage with a suitable key.

3. Locking device according to claim 2, wherein said connective means comprise a hexagonal cavity with a center rod.

4. Locking device according to claim 1, including positioning means cooperating with said locking pin designed to establish the two correct positions for said locking pin.

5. Locking device according to claim 4, wherein the positioning means comprise a couple ball-spring or a couple plunger-spring, housed in a suitable cavity, which cooperate with positioning cavities in said locking pin.

* * * * *